US011654325B2

(12) United States Patent
Leadbetter

(10) Patent No.: US 11,654,325 B2
(45) Date of Patent: May 23, 2023

(54) BARBELL GRIPS

(71) Applicant: New Growth Fitness LLC, Lee's Summit, MO (US)

(72) Inventor: Matt Christopher Leadbetter, Lee's Summit, MO (US)

(73) Assignee: New Growth Fitness LLC, Lee's Summit, MO (US)

( * ) Notice: Subject to any disclaimer, the term of this patent is extended or adjusted under 35 U.S.C. 154(b) by 0 days.

(21) Appl. No.: 17/562,263

(22) Filed: Dec. 27, 2021

(65) Prior Publication Data

US 2022/0118306 A1 Apr. 21, 2022

Related U.S. Application Data

(63) Continuation of application No. 16/782,028, filed on Feb. 4, 2020, now Pat. No. 11,266,870.

(51) Int. Cl.
*A63B 21/072* (2006.01)
*A63B 21/00* (2006.01)

(52) U.S. Cl.
CPC ..... *A63B 21/4035* (2015.10); *A63B 21/0724* (2013.01)

(58) Field of Classification Search
None
See application file for complete search history.

(56) References Cited

U.S. PATENT DOCUMENTS 1,395,793 A * 11/1921 Broschart ..... B43K 23/004 401/6
1,598,873 A * 9/1926 Peterson ..... B43K 23/004 401/98
4,867,444 A * 9/1989 Castillo ..... A63B 21/4035 482/106
5,415,607 A * 5/1995 Carpenter ..... A63B 21/0728 482/106
8,128,541 B2 * 3/2012 Hartman ..... A63B 21/4017 482/122
10,806,987 B2 * 10/2020 Burns ..... A63B 21/4035
2002/0094223 A1 * 7/2002 Androphy ..... B43K 23/004 401/6
2008/0040891 A1 * 2/2008 Tyler ..... A63B 21/4035 16/421
2009/0197742 A1 * 8/2009 Hartman ..... A63B 21/026 482/92
2009/0275447 A1 * 11/2009 Fishman ..... A63B 21/072 482/139
2009/0275448 A1 * 11/2009 Fishman ..... A63B 21/072 482/139
2012/0129664 A1 * 5/2012 Perry ..... A63B 71/14 482/139
2012/0179226 A1 * 7/2012 Graham ..... A63B 21/0004 607/111
2016/0158594 A1 * 6/2016 Penney ..... A63B 21/4035 264/331.13

(Continued)

*Primary Examiner* — Joshua Lee
(74) *Attorney, Agent, or Firm* — Bradley IP, LLC; Sean T. Bradley

(57) ABSTRACT

A set of angled grips for attachment to a weightlifting bar, such as a barbell bar or similar device, in order to provide an optimized gripping surface for a user's hands in terms of increased friction and comfort of the grips, thickness and circumference of the grips, and ergonomic angle of each grip surface relative to the bar.

15 Claims, 12 Drawing Sheets

(56) References Cited

U.S. PATENT DOCUMENTS

| | | | | |
|---|---|---|---|---|
| 2018/0021662 | A1* | 1/2018 | Carpinelli | A63B 71/12<br>482/104 |
| 2018/0264313 | A1* | 9/2018 | Boysen | A63B 21/0724 |
| 2019/0059568 | A1* | 2/2019 | Orlando | A46B 7/042 |
| 2020/0069995 | A1* | 3/2020 | Zelazny | A63B 21/4035 |

* cited by examiner

BARBELL GRIPS

CROSS REFERENCE TO RELATED APPLICATION

This application is a continuation of the co-pending nonprovisional patent application, Ser. No. 16/782,028, filed Feb. 4, 2020.

FIELD OF THE INVENTION

The present invention relates to athletic equipment, and more particularly to angled barbell grips for attachment to a barbell or other weightlifting bar to provide an ergonomically optimized gripping surface for a user's hands.

BACKGROUND OF THE INVENTION

After strength training and lifting weights for 15 years, the inventor began to experience severe joint pain and discomfort during and after workouts. Eventually, the inventor sought help from a sports medicine chiropractor and physical therapist. Advice was provided to discontinue barbell exercises, and instead use dumb bells and weight machines. This would allow the inventor's arms to move independently of one another, and his wrist would be able to rotate to allow for a more neutral and natural grip upon a bar. The combination of these two factors lead to less pain and stress on the inventor's wrist, elbow, and shoulder and helped him avoid more serious injuries. After avoiding barbell exercises altogether, his pain and discomfort disappeared almost entirely. Although the pain relief was significant, the inventor missed the barbell movements to which he had grown so accustomed. Barbell exercises allow the user to move much more weight and truly push personal limits to help build more muscle and grow stronger. In order to resume barbell workouts, the inventor began to consider ways to allow his wrists to orient to the bar at a physiologically more neutral and natural angle to ensure that he maintain proper form and reduce unhealthy stress upon his joints.

Prior art weightlifting bars that are prevalent in most gyms have serious deficiencies, including static (immovable) gripping surfaces placed either too narrow or too wide for most users. The typical prior art bars include spaced-apart gripping surfaces that are either spaced too closely to one another (i.e., spaced too narrow) or spaced too far apart from one another (i.e., spaced too wide) to allow comfortable, ergonomic movement for many users. Because these prior art gripping surfaces are typically static—for example, comprising sections of circumferential knurling on the bar itself—these prior art bars and bar surfaces provide only a few predetermined options for hand placement.

Eventually, the inventor conceived of an idea for a barbell grip that would allow the user to (a) move a pair of barbell grips to a user-determined and selected optimal grip placement width, and to (b) rotate the barbell grips to a user-determined and selected optimal desired angle relative to the barbell. Most prior art barbell grips effectively increased the diameter of the bar but did not orient to the bar at an angle. The "thick grip" prior art products of enhanced diameter typically advertised that a larger diameter hand grip upon a bar would help stabilize a user's joints. While some stabilization might be afforded due to a tighter handgrip, hand placement with such prior art grips is still fully pronated, with palms down and substantially parallel to the bar, or supinated, with palms up and substantially parallel to the bar, just as they were when gripping a typical straight bar directly. In addition, these prior art thick grips can cause additional stress upon a user's wrist, elbow and shoulder joints, because when using them a user can no longer as easily slightly rotate their hands upon the bar to slightly ease pronation during use to at least slightly/minimally relieve such stress (albeit while also reducing the ability to lift heavier weights, or reducing the ability to endure a desired number of repetitive lifts). While an increased diameter bar grip by itself may somewhat help to engage more muscles throughout the upper body, it still does not solve the problem of pronation and suboptimal hand placement upon a bar and it does not allow a user to comfortably perform major lifts like bench pressing and bar bell rows.

All grips in the prior art known to the inventor that are capable of providing an angled grip surface comprise only one grip conformation, such that two identical grips of the same grip conformation must be placed upon a bar when used in two-handed bar exercises like bench presses. When two grips of the same conformation are placed upon a bar, one must be flipped or rotated around an axis transverse to the bar to achieve a mirrored angle. This forces the longitudinal slit in each grip to face in an opposite direction to the other grip, and thereby places one of the longitudinal slits against the palm of a user. This destabilizes the grip and creates a disparity between the grips in terms of feel to the user, especially when heavy weights are in use upon the bar. Such grips are also more prone to slipping off the bar and are difficult to align with one another with regard to angles relative to the bar.

Therefore, there exists a need for a barbell grip that provides a solution to these deficiencies in the prior art.

SUMMARY OF THE INVENTION

Embodiments of the present invention comprise, in part, a barbell grip that orients to the bar at an angle. This allows a user to perform exercises such as bench press and barbell row with a more neutral grip than previously possible using grip devices in the prior art. It provides a means to exercise without joint stress or pain during or after a workout. The grip of the present invention can be used with barbells (and other exercise devices that include a bar element) to perform exercises such as bicep curl variations, tricep extension variations, overhead presses, bench presses, and pull ups, among others. These exercises can be performed using a more natural and effective hand orientation than without the grip. The barbell grips of the present invention also allows the user to add a tremendous amount of variation to workouts by performing each selected exercise at several different user-determined hand placements and grip angles simply by moving the barbell grips across the bar to different positions and relative widths to one another, or by rotating the grips around the longitudinal axis of the bar.

Structurally, embodiments of the present invention typically comprise a substantially cylindrical, rubber or rubber-like, barbell grip with an Internal or Interior Bore that runs through the Main Body diagonally, a Slit Opening (Slit) that runs parallel to the exterior of the Main Body, and External Main Grooves in the outer surface of the barbell grip that follow and indicate the path of the Internal Bore.

The angled orientation of the grip to the bar allows the user to perform barbell exercises with a more natural grip, and the larger grip diameter helps stabilize joints and engage more muscle fibers. The barbell grip can be moved anywhere along the bar and the grips can be rotated to create the optimal grip width and angle for each individual user.

With more specificity, elements of embodiments of the present invention include:

An Internal Bore that runs through the Main Body at an angle so that the grip attaches to the bar at an angle and allows a more neutral and natural grip for the user performing barbell exercises.

An Exterior Main Groove (an elongated depression on the exterior surface of the Main Body) follows and traces the path of the underlying Internal Bore to indicate to the user how the barbell grip should be placed on the bar for optimal grip angle and orientation, and on which side of the bar each barbell grip should be placed. Without the External Main Groove as an indicator, it would be very difficult for the user to accurately discern the location and orientation of the Internal Bore that runs through the barbell grip, and thus how the barbell grip should be optimally placed upon the bar.

The Slit runs diagonal to the Internal Bore and substantially parallel to the longitudinal axis of the Main Body. This allows the barbell grip to wrap around the bar fully so that each parallel cross section of the bar is supported by the barbell grip at several points. If the Slit were to run parallel to the Internal Bore, it would be much easier for the bar to accidently slip out of the barbell grip while in use.

While in use, the Slit of each barbell grip in a matched, cooperating pair can face the same direction because the barbell grips in such a pair are not structurally identical, rather, the barbell grips in a matched pair are typically substantially symmetrical to one another but have mirrored symmetry versus identically oriented structural elements. Thus, the barbell grips can be safely used with heavy weight mounted on the bar, and with exercises where weight is held over the user's body. For example, if one Slit were to be facing the user and the other were to be facing away while performing a bench press (in which the user lays on his or her back and pushes weight above his or her chest), there would be tremendous risk the weight would cause the bar to fall through the Slit and into the user's hand, or even through the user's hand causing serious injury.

Certain embodiments of the present invention may comprise a barbell grip having a generally cylindrical main body, the main body having a longitudinal axis, and having a generally circular first end and an opposing generally circular second end. An internal bore extends through the main body from the first end to said second end, the bore diverging from the longitudinal axis at an angle thereto. A slit cuts through or sections the length of the main body from an outer surface of the main body toward the interior of the main body to meet the internal bore. The slit is disposed substantially parallel to the longitudinal axis of the main body. A first exterior main groove on the front of the main body extends from the first end to the second end of the main body and overlies the internal bore to thereby indicate the location and angle of the internal bore to a user. A second exterior main groove on the rear of the main body extends from the first end to the second end of the main body and similarly overlies the internal bore to also indicate the location and angle of the internal bore to a user. The aforementioned slit is completely or substantially disposed within this second exterior main groove. A first end flange is located proximate the first end and comprises a flared portion of increased diameter relative to the average diameter of the main body. A second end flange is located proximate the second end and comprises a flared portion of increased diameter relative to the average diameter of the main body. In other words, the flanges each have increased diameters relative to the diameter of the main body located between the flanges and extend radially outward from the surface of the main body at either end thereof.

Embodiments of a barbell grip according to the present invention may comprise a generally cylindrical main body having a longitudinal axis. The main body has a generally circular first end and an opposing generally circular second end. An internal bore extends through the main body from the first end to the second end, presenting a substantially circular opening at each end. The bore is not parallel to the longitudinal axis but diverges from the longitudinal axis at an angle thereto. A first exterior main groove extends from the first end to the second end and overlies the internal bore to indicate the location and angle of the internal bore to a user. The first exterior main groove comprises an area of reduced thickness of the main body. A slit cuts through or sections the main body from an outer surface thereof to the internal bore. The slit is disposed substantially parallel to the longitudinal axis of the main body. The slit separates sections or portions of the main body that overlie the internal bore to form two generally triangular-shaped flaps. A portion of each of these flaps extends over and covers a portion of the internal bore in excess of the radius of the internal bore.

Other advantages of the invention will become apparent from the following description taken in connection with the accompanying drawings, wherein is set forth by way of illustration and example several embodiments of the present invention.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
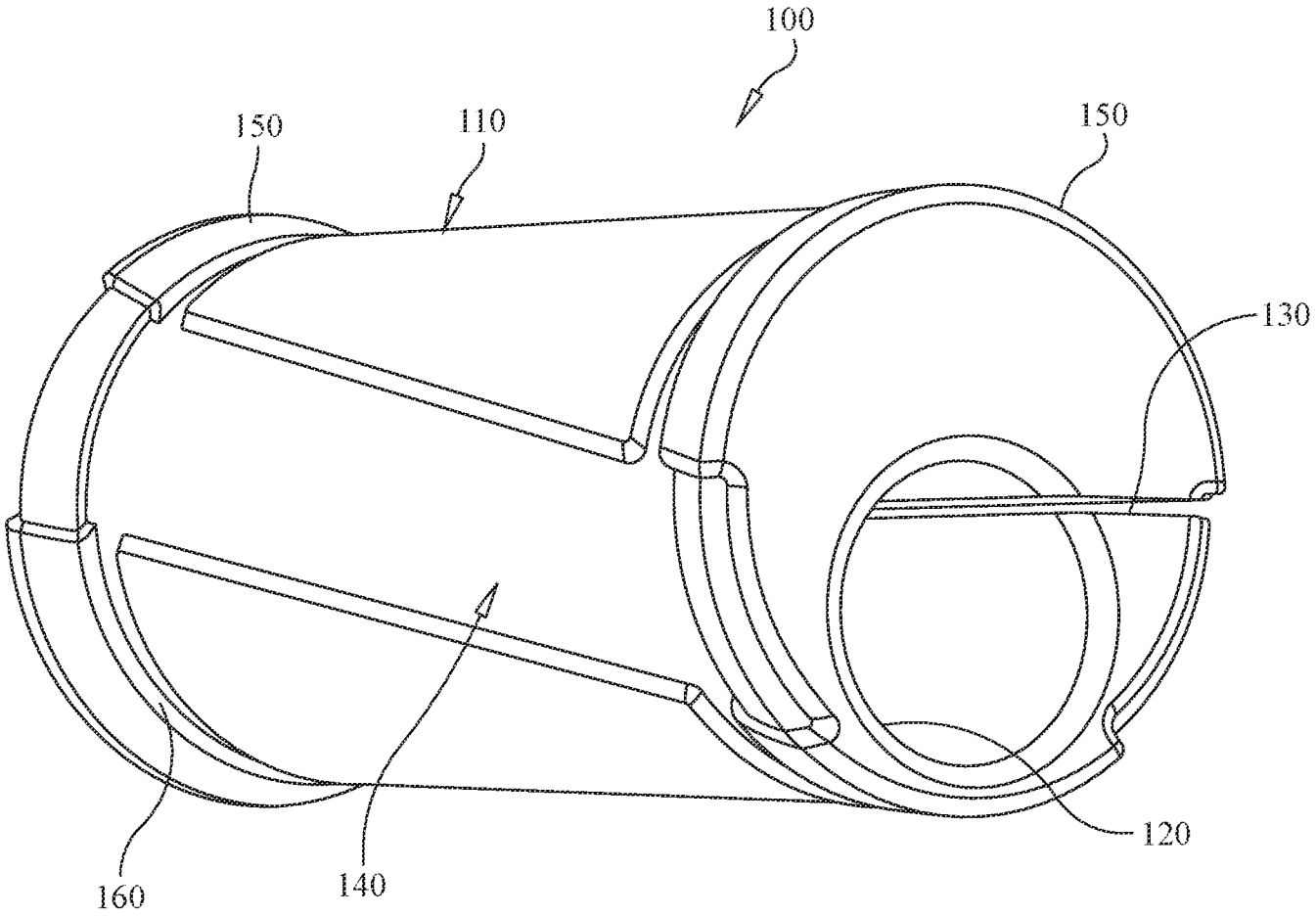
FIG. 1 is an enlarged, front, right perspective view of a barbell grip.

FIG. 1 is an enlarged, front, right perspective view illustrating components of an embodiment of the barbell grip 100 of the present invention. The Main Body 110 of the barbell grip 100 is substantially cylindrical in shape with a diameter optimized to allow most adults to comfortably and securely wrap their hands at least partially or substantially around the barbell grip 100 when grasping or gripping it for use. Typically, the Main Body 110 has a large enough diameter relative to length so that the Internal Bore 120 can be at a 5 degree or greater angle to the exterior edge (or to the longitudinal axis) of the Main Body 110, with the Internal Bore 120 reaching from one end of the Main Body 110 to the other to present an opening at either end of the Main Body 110.

Figure 2:
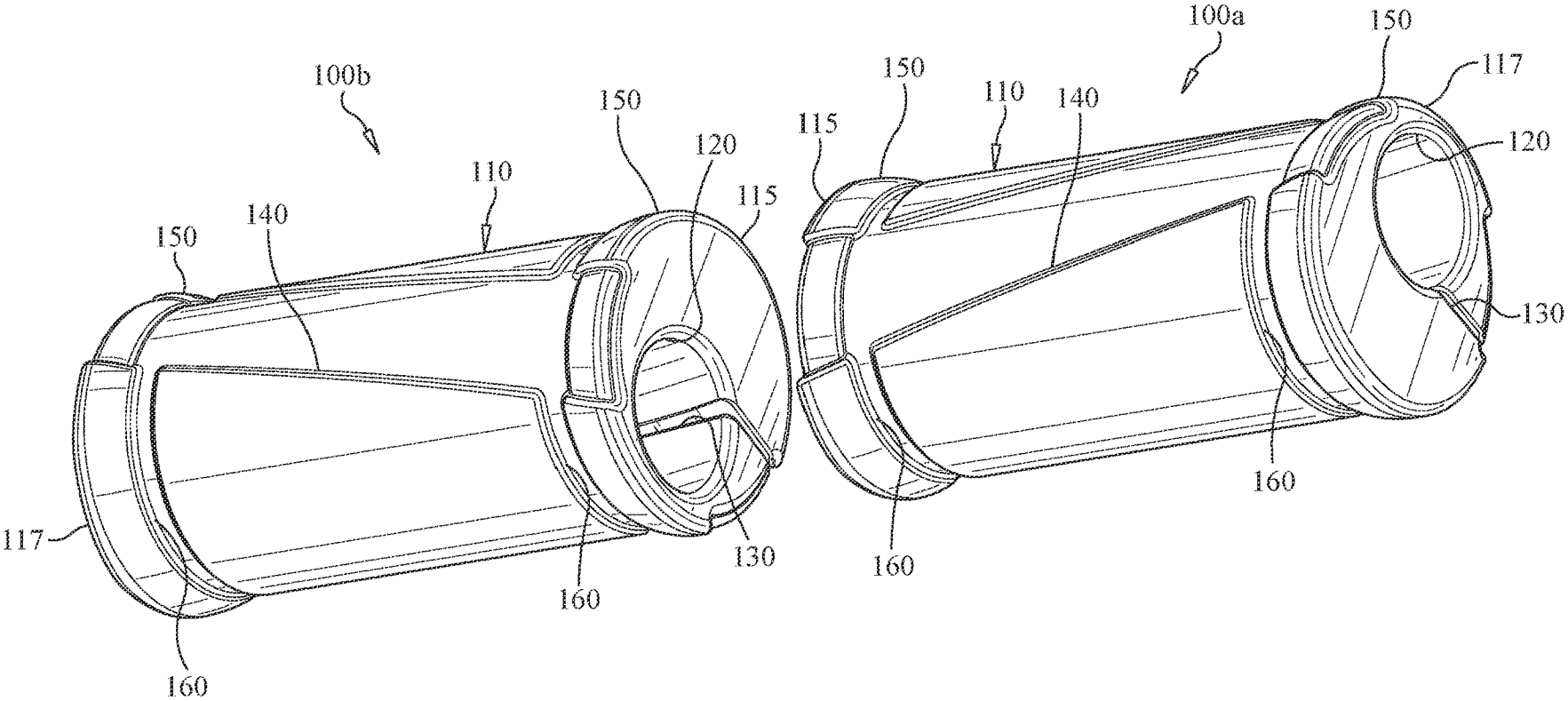
FIG. 2 is a front, right perspective view of a pair or set of barbell grips having mirrored symmetry.
Figure 3:
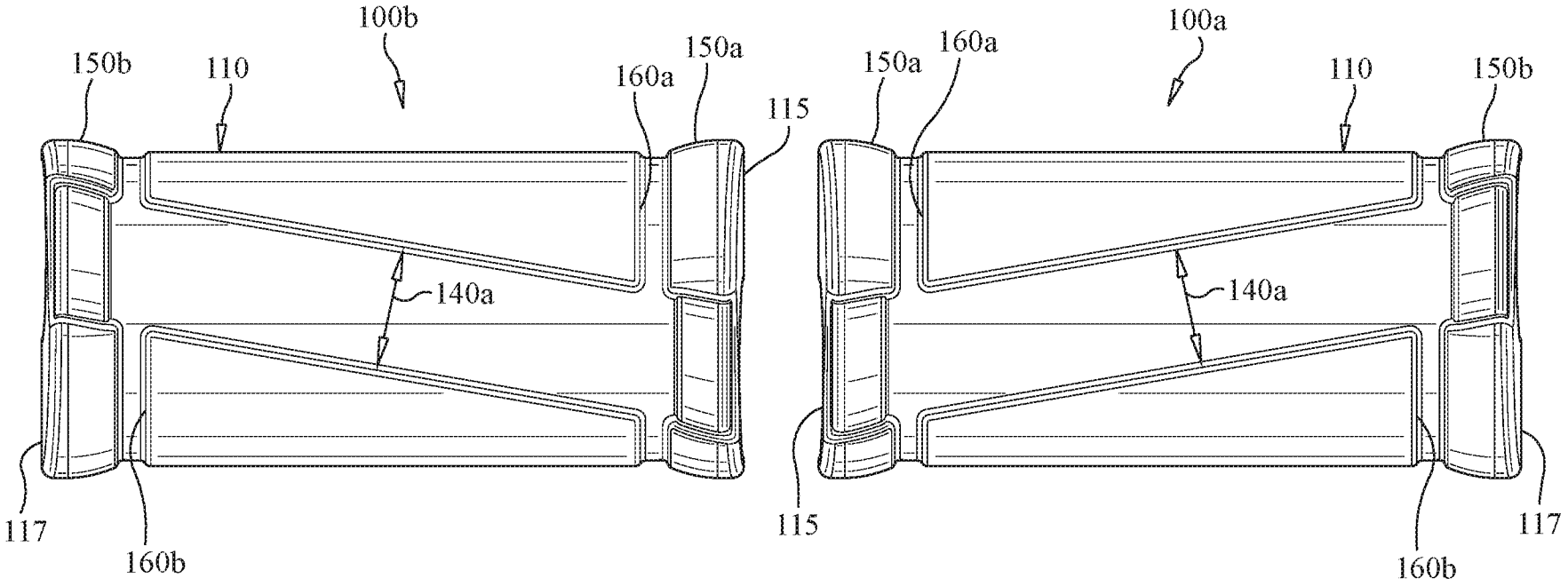
FIG. 3 is a front elevation of the barbell grips of FIG. 2, showing a right barbell grip and a left barbell grip having mirrored symmetry.
Figure 4:
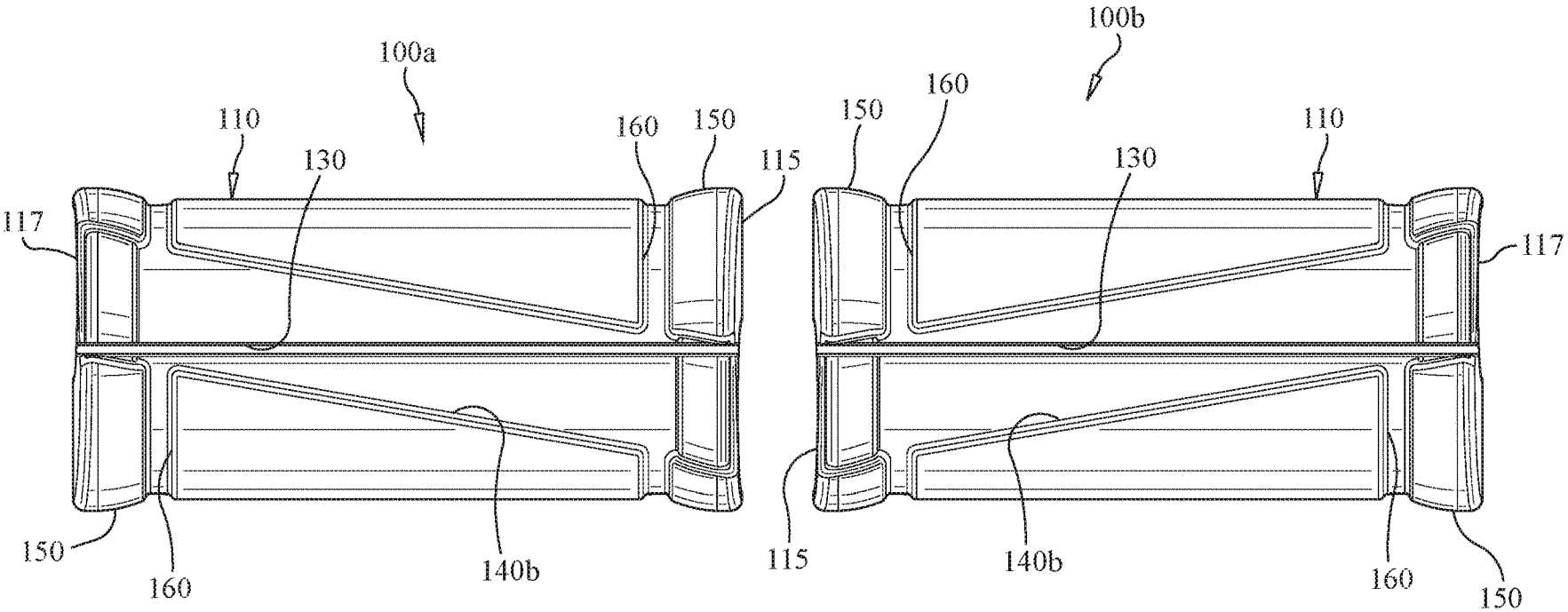
FIG. 4 is a rear elevation of the barbell grips of FIG. 3.
Figure 11:
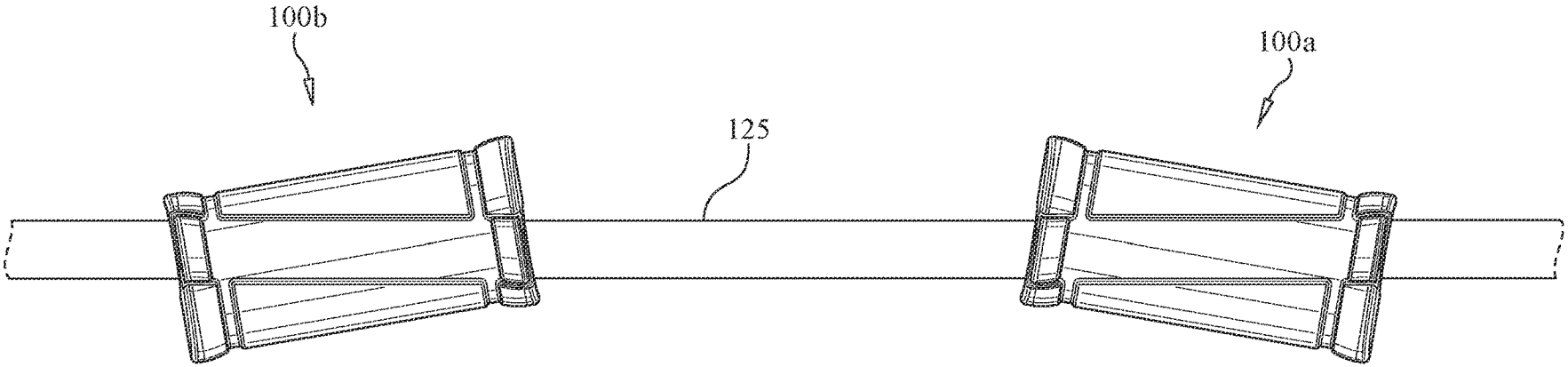
FIG. 11 is an elevation of the barbell grips of FIG. 3 positioned and mounted in mirrored symmetry upon a weightlifting bar.
Figure 13:
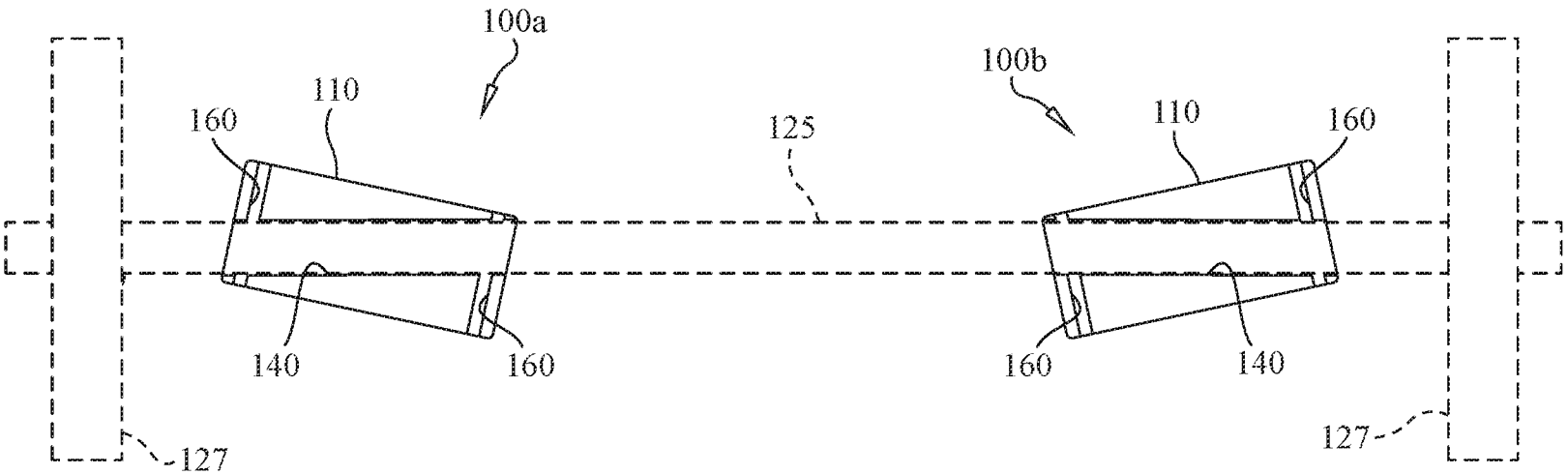
FIG. 13 is a diagram of two barbell grips mounted upon a weightlifting bar.

The increased diameter of the Main Body 110 (in comparison to a barbell or other weightlifting bar) benefits the user by more evenly distributing weight in the hand, engaging more hand and forearm muscles, and encouraging a tighter grasp which engages other muscle groups and stabilizes joints. Note that barbell grips 100 of the present invention are often used in pairs, particularly on elongated bars with weights located proximate the ends of such bars, such as bench press or curling bars (see FIG. 13). Such pairs of barbell grips 100 are typically constructed so as to mirror one another's features, as shown in FIGS. 2-4, for example. While the barbell grips 100 may be used in any position desirable and comfortable to the user, the barbell grips 100 are typically positioned spaced apart upon a bar 125 at approximately shoulder width and in mirrored symmetry relative to one another, as shown in FIG. 11 or 13. It should be appreciated that although sometimes designated herein as right 100*a* or left 100*b* barbell grips, for ease and clarity of description when describing a cooperating, matched pair of barbell grips 100, the position of the barbell grips 100 may be reversed for certain uses if desired. It should be further appreciated that barbell grips 100 described herein may be referenced using reference numeral 100 when referred to in general (as earlier in this sentence) or when referring to a single barbell grip 100. When specifically referring to individual barbell grips 100*a* and 100*b* in a pair, reference numerals 100*a* and 100*b* may be used to distinguish between or otherwise identify the grips.

FIG. 2 is a front, right perspective view of a pair or set of barbell grips 100*a* and 100*b* having mirrored symmetry to one another. FIG. 3 is a front elevation showing the right barbell grip 100*a* and left barbell grip 100*b* of FIG. 2, and FIG. 4 is a rear elevation of the barbell grips 100*a* and 100*b* of FIG. 3.

Figure 14:
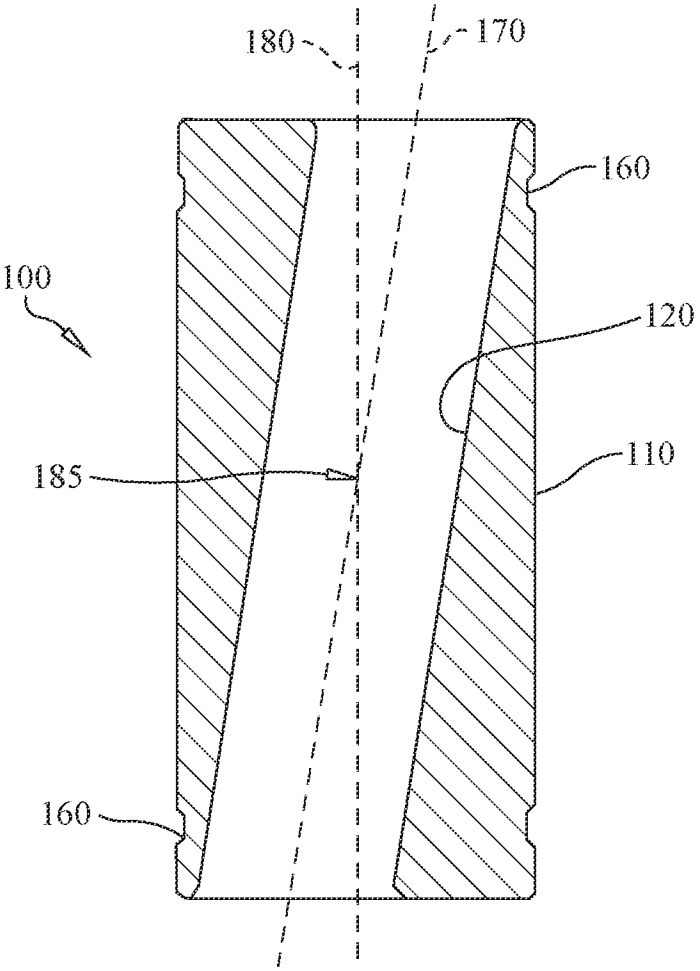
FIG. 14 is a cross sectional diagram of a barbell grip 100.

With further reference to the figures, and in particular the diagram in FIG. 14, the Internal Bore 120 in each barbell grip 100 is oriented at a 5 degree or greater angle to the exterior surface of the Main Body 110 so that the Internal Bore 120 runs diagonally through the Main Body 110 relative to both the exterior surface of the Main Body 110 and to the longitudinal axis of the Main Body 110. FIG. 14 is a cross sectional diagram of a barbell grip 100 illustrating that the Internal Bore longitudinal axis 170 (shown in a dotted line) deviates at angle from the Main Body longitudinal axis 180 (shown in a dashed line). In addition, the Slit 130 (not shown) is substantially coplanar with the Main Body longitudinal axis 180, and is not coplanar with the Internal Bore longitudinal axis 170, typically intersecting with the Internal Bore longitudinal axis 170 only at a point 185 generally midway along such axis 170. The angle of the Internal Bore 120 relative to the Main Body 110 allows the Main Body 110 to be oriented at the same angle to a weightlifting bar 125 (e.g. barbell, curling bar or bench press bar) to allow for a more neutral grip while performing weightlifting exercises, which helps to more naturally align joints to avoid unhealthy pain and stress.

Figure 15:
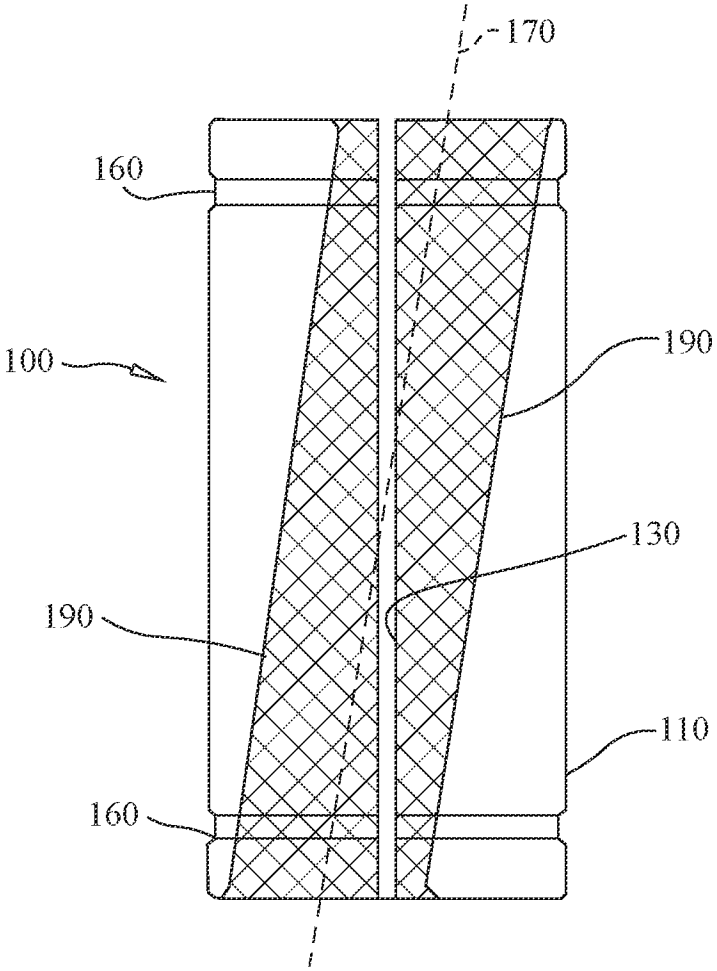
FIG. 15 is a diagram of a rear view of a barbell grip with shading applied to indicate portions of the surface of the barbell grip that overlie the bore.

As may be most readily observed in FIGS. 4 and 15, the Slit 130 runs substantially parallel to the exterior surface of the Main Body 110 (and also to the longitudinal axis of the Main Body 110) and from one corner of the Internal Bore 120 on one end (when viewed in cross section), to a diagonally opposing corner of the Internal Bore 120 on the other end. The Slit 130 is oriented to the Internal Bore 120 at an angle so that the Main Body 110 remains securely attached to a bar 125 while in use.

Figure 9:
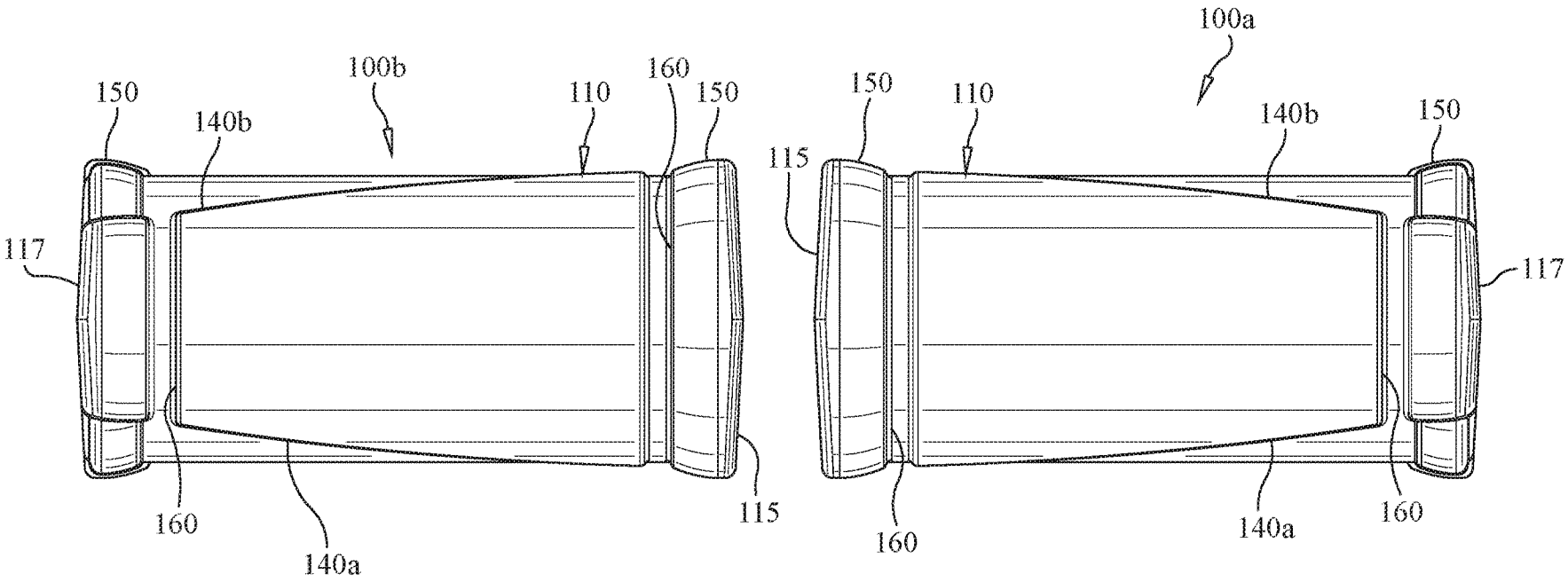
FIG. 9 is a top plan view of the of the barbell grips of FIG. 3.
Figure 10:
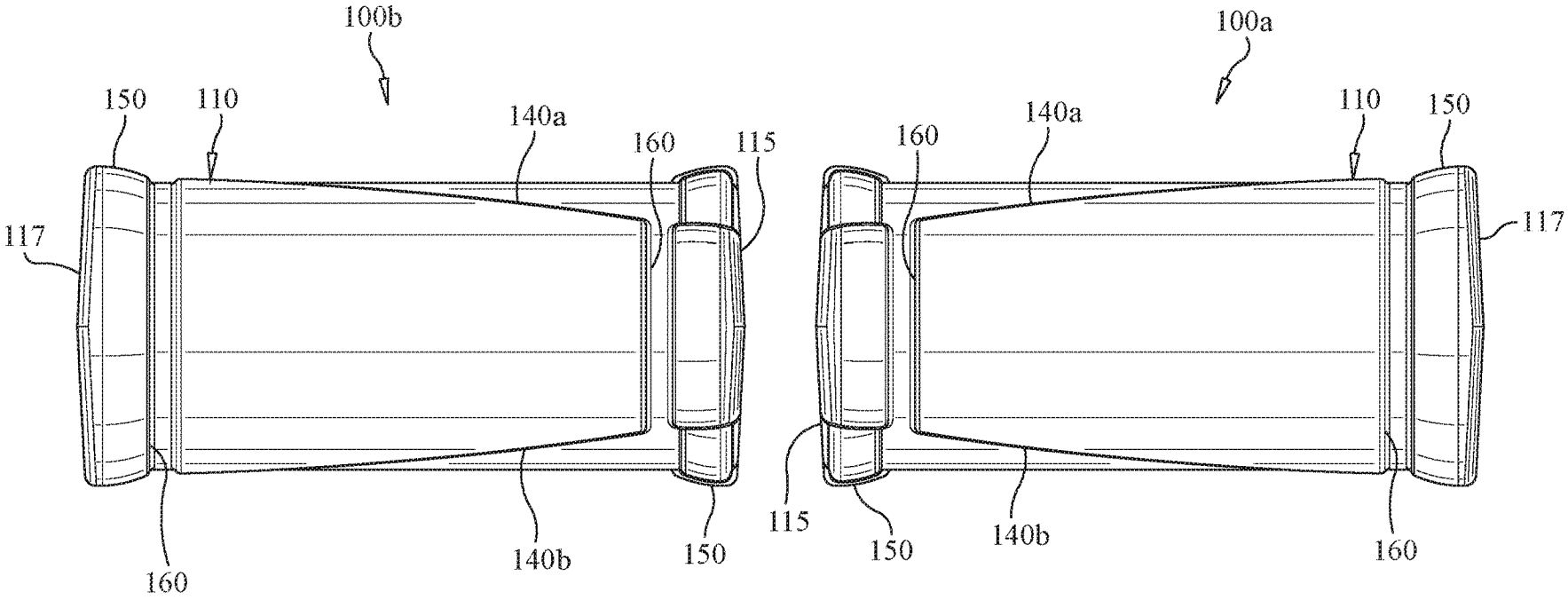
FIG. 10 is a bottom plan view of the barbell grips of FIG. 3.

The Exterior Main Groove 140 overlies the Internal Bore 120, and indicates the direction and angle of the Internal Bore 120 so that the user can discern and visualize the location and angle of the Internal Bore 120, and thereby better understand how to attach the barbell grip 100 to the weightlifting equipment to achieve the desired grip angle. Typically, one such Exterior Main Groove 140 is located on each opposite side of the Main Body 110, so that each barbell grip 100 has two Exterior Main Grooves 140 (a first Exterior Main Groove 140*a* and a second Exterior Main Groove 140*b*) located on opposing sides of the Main Body 110, each indicating the location and angle of the underlying Internal Bore 120. This disposition of the Exterior Main Grooves 140 allows a user to readily align a barbell grip 100 in a desired and selected location upon a weightlifting bar regardless of the barbell grip 100 orientation. The first Exterior Main Grooves 140*a* are located on the front of the barbell grips 100, and the second Exterior Main Grooves 140*b* are located on the rear of the barbell grips 100 and are sectioned by the Slit 130, as shown in FIGS. 3-8. Exterior Main Grooves 140 also add texture to the exterior surface of the Main Body 110, thus reducing the possibility of the user's hand slipping during use of the barbell grip 100. FIG. 9 is a top plan view of the of the barbell grips 100*a* and 100*b* of FIG. 3, and FIG. 10 is a bottom plan view of these barbell grips.

An End Flange 150 is located on each end of the Main Body 110, and is raised or flared to have a larger diameter than the portion of the Main Body 110 located between the End Flanges 150 (or to have a larger diameter than the average diameter of the Main Body 110), to help ensure that the user's hands remain in place while performing exercises. When the barbell grip 100 is in use, the user's index and pinky fingers will typically rest near or against the inside of each End Flange 150, and often upon the Exterior End Grooves 160 described below. The barbell grips 100 have first End Flanges 150*a* located at the first, proximate ends 115 and have second End Flanges 150*b* located at second, distal ends 117, as indicated in FIG. 3.

Figure 6:
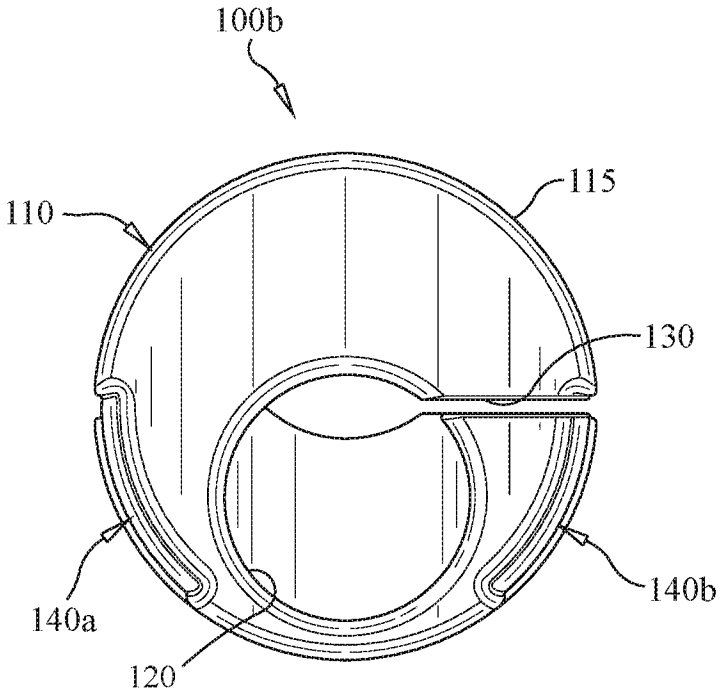
FIG. 6 is an elevation of the right or proximate end of the left barbell grip of FIG. 3.
Figure 5:
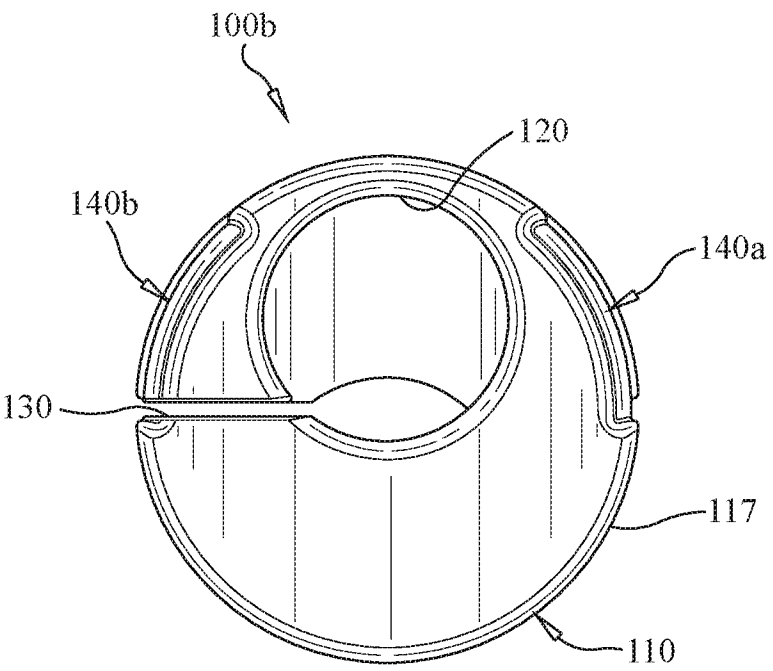
FIG. 5 is an elevation of the left or distal end of the left barbell grip of FIG. 3.
Figure 8:
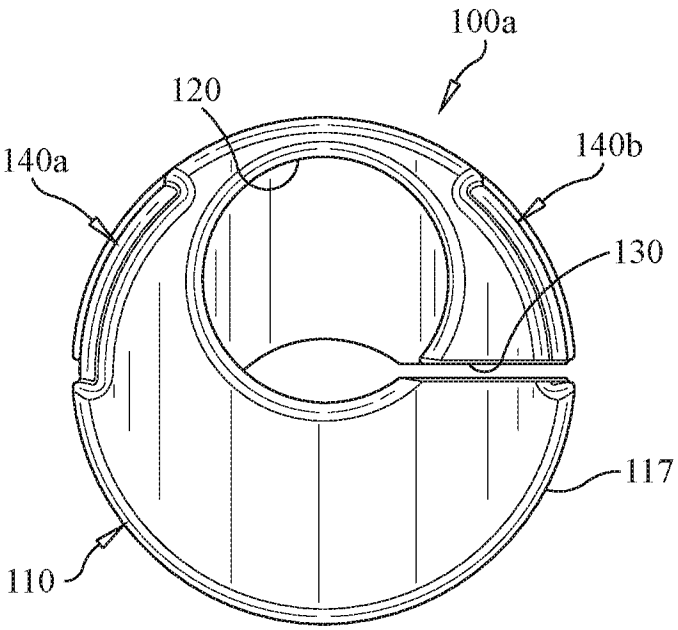
FIG. 8 is an elevation of the right or distal end of the right barbell grip of FIG. 3.
Figure 7:
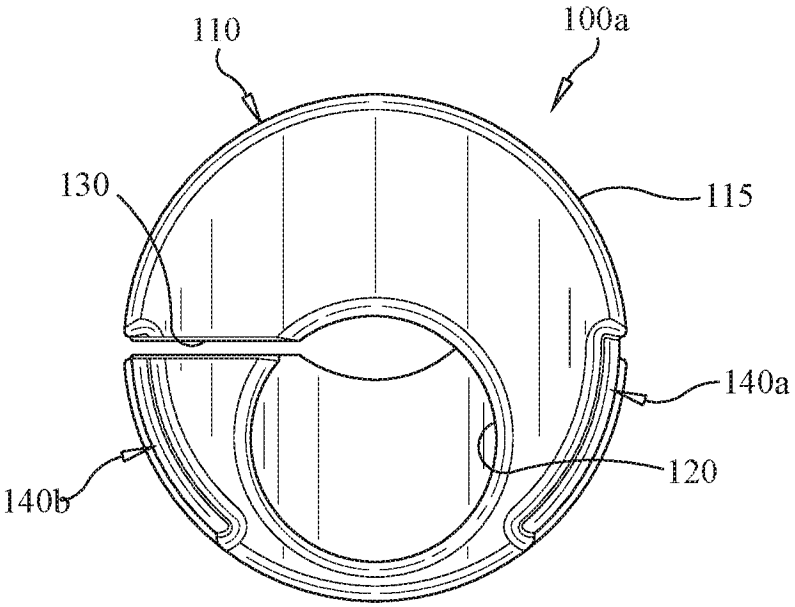
FIG. 7 is an elevation of the left or proximate end of the right barbell grip of FIG. 3.

FIGS. 5 through 8 illustrate left and right ends of each of the left 100*b* and right 100*a* barbell grips shown in FIGS. 2-4. Each barbell grip 100 comprises a substantially circular first end and an opposing substantially circular second end. For purposes of clarity, and with reference to the orientation shown in FIGS. 2-4, the first ends will be referred to as proximate ends 115 and the second ends will be referred to as distal ends 117, as they are positioned relative to one another in FIGS. 2-4 and also FIGS. 9-11. FIG. 5 is an elevation of the left or distal end 117 of the left barbell grip 100*b* of FIG. 3. FIG. 6 is an elevation of the right or proximate end 115 of the left barbell grip 100*b* of FIG. 3. FIG. 7 is an elevation of the left or proximate end 115 of the right barbell grip 100*a* of FIG. 3. FIG. 8 is an elevation of the right or distal end 117 of the right barbell grip 100*a* of FIG. 3.

Exterior End Grooves 160 are located along the circumference of the Main Body 110 proximate and inward of the End Flanges 150. Exterior End Grooves 160 also help ensure that a user's hands remain in place while performing exercises. When the barbell grip 100 is in use, a portion of the user's index and pinky fingers will typically rest within the Exterior End Grooves 160. The Exterior End Grooves 160 typically wrap all the way around the circumference of the Main Body 110, but in certain embodiments may only partially wrap around the entire circumference or be broken or interrupted by other Main Body 110 structures. The barbell grips 100 have first Exterior End Grooves 160*a* located inward of the first End Flanges 150*a* and have second Exterior End Grooves 160*b* located inward of the second End Flanges 150*b*, as indicated in FIG. 3.

Figure 12:
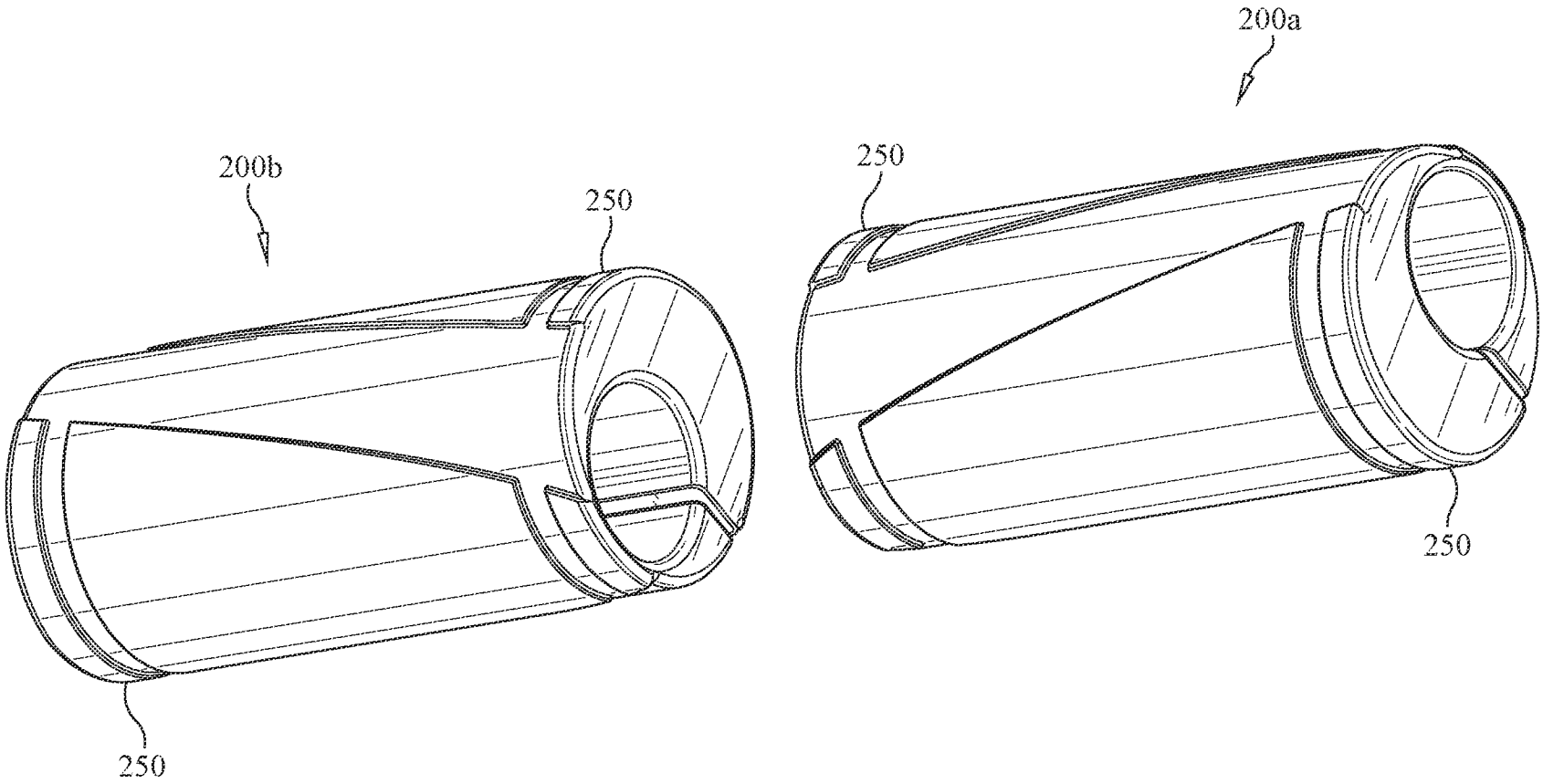
FIG. 12 is a front, right perspective view an alternative embodiment of a pair of barbell grips having mirrored symmetry.

FIG. 12 is a front, right perspective view of an alternative embodiment of a pair of barbell grips 200*a* and 200*b* having mirrored symmetry. As shown, the End Flanges 250 of these grips are not flared as are the End Flanges 150 of the previously described embodiment, but rather are of similar or identical diameter to a substantial portion of the rest of the Main Body of these grips 200*a* and 200*b*.

FIG. 13 is a diagram showing two barbell grips 100 (shown in solid lines) attached in spaced apart arrangement upon a weightlifting bar 125 having a plate weight 127 mounted on either end (shown in phantom lines). As shown, the barbell grips 100 are not identical but have mirrored horizontal symmetry, whereby, although the Internal Bore 120 is not visible in this figure, its position (and the position of the barbell grips 100 upon the bar 125) is clearly indicated by the Exterior Main Grooves 140. By mirrored horizontal symmetry, the inventor means that two paired barbell grips 100 typically have mirrored features relative to one another if viewed next to one another and positioned so that the barbell grip 100 longitudinal axes are aligned horizontally and with one another.

As shown in FIG. 15, sections of the Main Body 110 of the grip 100 that overlie the Internal Bore 120 and are separated from one another by the Slit 130 may be described as flaps 190 that cooperate to cover a bar held within the Bore 120. Because of the novel design of the flaps 190, which further distinguishes the grip 100 from the prior art, a portion of each flap extends to cover a substantial width of a bar 125 held within the Bore 120, and often covers in excess of the radius of the bar 125 (which is typically closely approximate to the radius of the Bore 120). Because the Slit 130 traverses (transits/extends) over the Bore 120 and bar 125 at angle to the longitudinal axis of each, which creates these flaps 190 having more extended coverage of the underlying surface of the bar, a system is created that locks the barbell grip 100 to the bar 125 whether the barbell grip 100 is positioned with the flaps 190 covered by the palm of the user's hand or (more typically) by the fingers of the user.

It is to be understood that while certain forms of this invention have been illustrated and described, it is not limited thereto except insofar as such limitations are included in the following claims and allowable equivalents thereof.

Having thus described the invention, what is claimed as new and desired to be secured by Letters Patent is:

1. A barbell grip comprising:

a generally cylindrical main body having a longitudinal axis, an internal bore extending through said main body at an angle divergent from said longitudinal axis, a slit sectioning said main body from a first outer surface overlying said internal bore inward to connect with said internal bore, said slit disposed parallel to said longitudinal axis of said main body, and an indicator extending along a second outer surface of said main body and overlying said internal bore to indicate the location and angle of said internal bore relative to said longitudinal axis.

2. The barbell grip of claim 1 wherein said indicator comprises an elongated depression.

3. The barbell grip of claim 1 wherein said indicator comprises an external groove.

4. The barbell grip of claim 1 wherein said indicator comprises a textured surface.

5. The barbell grip of claim 1 further including a second indicator extending along a third outer surface of said main body and overlying said internal bore to indicate the location and angle of said internal bore relative to said longitudinal axis.

6. The barbell grip of claim 1 wherein said main body includes a generally circular first end and an opposing generally circular second end.

7. The barbell grip of claim 6 further including a first end flange extending circumferentially outward from said main body proximate said first end.

8. The barbell grip of claim 7 further including a second end flange extending circumferentially outward from said main body proximate said second end.

9. The barbell grip of claim 6 further including a first exterior end groove located around the circumference of said main body and proximate to and inward of said first end.

10. The barbell grip of claim 6 further including a second exterior end groove located around the circumference of said main body and proximate to and inward of said second end.

11. A set of barbell grips comprising:

two generally cylindrical main bodies, each of said main bodies having a longitudinal axis, each of said main bodies having an internal bore extending therethrough at an angle divergent from their respective longitudinal axis, each of said main bodies having a slit sectioning therethrough from an outer surface thereof to their respective internal bore, whereby when said two main bodies are placed side by side with their longitudinal axes aligned and their slits facing the same direction outward, the angles of their internal main bores mirror one another.

12. The set of barbell grips of claim 11 further comprising indicators extending along the outer surfaces of each of said main bodies and overlying said internal bores to indicate the locations and angles of said internal bores relative to said longitudinal axes.

13. The set of barbell grips of claim 12 wherein said indicators comprise external grooves.

14. The set of barbell grips of claim 12 wherein said indicators comprise textured surfaces.

15. A set of barbell grips comprising:

two generally cylindrical main bodies, each of said main bodies having a longitudinal axis, each of said main bodies having an internal bore extending therethrough at an angle divergent from their respective longitudinal axis, each of said main bodies having a slit sectioning therethrough from an outer surface thereof to their respective internal bore, whereby when said two main bodies are placed upon a bar, with their internal bores therefore in longitudinal alignment, and their slits facing the same direction outward, the angles of their longitudinal axes relative to said bar mirror one another.

* * * * *